33-247 SR
12/21/76 XR 3,997,974

United States Patent [19]
Larson

[11] 3,997,974
[45] Dec. 21, 1976

[54] ARCHERY BOW SIGHTING MECHANISM

[76] Inventor: Marlow W. Larson, 2735 S. 4050 West, Ogden, Utah 84401

[22] Filed: Jan. 19, 1976

[21] Appl. No.: 650,412

[52] U.S. Cl. ..... 33/265; 33/247; 33/298; 350/10; 356/250

[51] Int. Cl.[2] ..... F41G 1/46; F41G 1/42; F41G 1/38

[58] Field of Search ..... 33/245, 246, 247, 265, 33/297, 298; 350/10; 356/247, 250

[56] References Cited

UNITED STATES PATENTS

| | | | |
|---|---|---|---|
| 729,848 | 6/1903 | Common | 356/247 |
| 2,243,793 | 5/1941 | Cummins | 33/245 |
| 3,227,035 | 1/1966 | Maillard | 356/247 |
| 3,279,071 | 10/1966 | Bilyeu et al. | 33/265 |
| 3,359,849 | 12/1967 | Friedman | 350/10 |
| 3,747,222 | 7/1973 | Benoit | 33/265 |
| 3,777,404 | 12/1973 | Oreck | 33/245 |

*Primary Examiner*—Henry K. Artis
*Assistant Examiner*—Richard R. Stearns

[57] ABSTRACT

Archery bow sighting structure incorporating an elongate housing and light shield interiorly annularly stepped to reduce glare. The housing is interiorly provided with mutually spaced sighting means, the forward sighting means comprising a centrally disposed lens having a central sighting dot. The lens is surrounded by viewing space so that a target can be viewed naturally by the eye, solely the central portion of the target being magnified by the lens. The rear lens means comprises a pendulum type sighting mechanism that is rotatively adjustable. An adjustment screw is provided for adjusting the dampening factor of the pendulum.

13 Claims, 5 Drawing Figures

ARCHERY BOW SIGHTING MECHANISM

FIELD OF INVENTION

The present invention relates to sighting mechanism and, more particularly, to sighting mechanisms for target bows which will be extremely reliable and versatile in use. A front lens having a sighting dot and a rear pendulum-type sight mechanism is used, but where the fixed portion of the rear sight is made rotatively adjustable.

DESCRIPTION OF PRIOR ART

Certain United States patents are in existance which bear upon the general concept of sights and sighting mechanisms, as follows:

| U.S. Pat. No. | Name |
|---|---|
| 3,212,190 | Larson |
| 2,351,103 | Brown |
| 2,642,661 | Frederickson |
| 1,961,517 | Klopsteg |
| 2,909,167 | Frederickson |
| 2,738,700 | Taylor |
| 2,190,500 | Brewer |
| 2,155,199 | Loomis |
| 2,073,856 | Forsling |
| 1,618,225 | Redfield |
| 1,318,424 | Williams |
| 539,470 | Carlson |
| 2,243,793 | Cummins |
| 2,039,907 | Jefferson |
| 3,777,404 | Oreck |
| 2,997,916 | Friedman |
| 2,949,816 | Carver |
| 1,171,310 | Bisbee |
| 2,554,133 | Von Arx |
| 2,834,118 | Jackson |
| 2,875,522 | Merrill et al |
| 2,987,820 | Butts |
| 2,998,652 | Zielinski |
| 3,013,336 | Pennington |
| 3,084,442 | Jacobson et al |

Foreign Patents

| Country | Patent No. |
|---|---|
| Germany | 139,978 |
| Switzerland | 99,540 |
| Switzerland | 197,619 |
| Switzerland | 201,195 |

These and other patents are believed to teach structures that are somewhat less desirable in certain respects, among which include lack of provision for sighting an object and magnifying only a central portion of the target option, with the lens itself including a sighting dot. Prior structures likewise have some difficulty as to interior glare from ambient light or sunlight conditions. Further, while pendulum sights are known, there have been difficulties in the past relating to the concept of special adjustment features whereby the fixed portion of the pendulum sight may be made rotatively adjustable. Finally, the pendulum itself is best made adjustable as to dampening factor, and this provision is absent in the prior art.

BRIEF SUMMARY OF THE INVENTION

According to the present invention the sighting mechanism or structure comprises a front sight simply consisting of a four-power magnifying lens, for example, that is essentially surrounded by annular viewing space between the lens and the over-all sight's housing. Such lens has a central sighting dot. Accordingly, the user is enabled to see naturally the target, with solely the central portion being aimed at subject to magnification. The rear sight, also enclosed in the housing structure, is of the pendulum type and includes a fixed portion that can be annularly rotatively displaced, this for adjustment purposes as hereinafter explained. The pendulum itself is provided with an adjustment screw designed to vary the dampening factor of the pendulum. The housing structure for the sighting mechanism is internally configured to substantially reduce if not eliminate glare.

OBJECTS

Accordingly, the principal object of the present invention is to provide a new and improved sighting mechanism.

A further object of the present invention is to provide an archery bow sighting mechanism suited particularly to target archery use.

An additional object is to provide a sighting mechanism for archery bows which includes a central magnifying lens provided with a dot sight and yet positioned in its housing such that unobstructed viewing space is provided essentially about the lens within its housing.

An additional object is to provide a bow sighting mechanism incorporating a sighting pendulum, the motion of which can be adjustably dampened.

An additional object is to provide a pendulum sight in a bow-sighting mechanism wherein that sight portion cooperating with the pendulum is rotationally adjustable.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

BRIEF DESCRIPTION OF THE PREFERRED EMBODIMENTS

Figure 1:
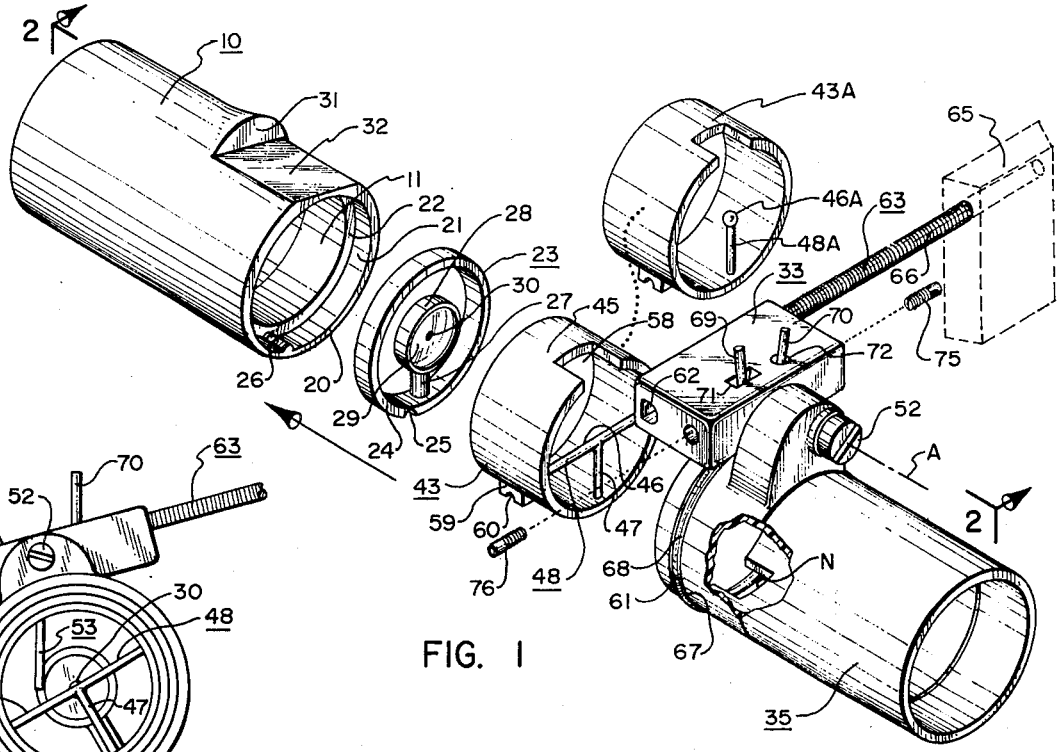
FIG. 1 is an exploded perspective view of a sighting mechanism constructed in a preferred form of the invention, an optional sight-reticle being shown laterally placed in the view.

In the drawings, housing 10 is interiorly hollow at 11 and includes in such interior a series of annular recesses 12–15 defined by shoulders 16-19 which are annular in character. The rear end 20 of housing 10 is provided with an annular end recess 21 as defined by shoulder 22. This recess is for the purpose of receiving lens-reticle 23. The latter includes an annular ring 24, seated within recess 21, and provided with key-way 25 that receives key 26 of housing 10. An upstanding support and sighting post 27 mounts interior annular ring 28 that is provided with a four-power lens 29, by way of example. Such lens has a central marking dot 30 which is preferably made by a round dot of paint or laquer and generally will be black, although other colors are possible.

In returning to a consideration of housing 10, it is seen that the same includes a sector shoulder 31 and cut plane 32 which in the aggregate form a mounting notch for receiving and cementing or liquid-welding in place member 33, hereinafter described. Such notch as formed by shoulder 31 and plane 32 is designated by the numeral 34 in FIG. 2.

Figure 2:
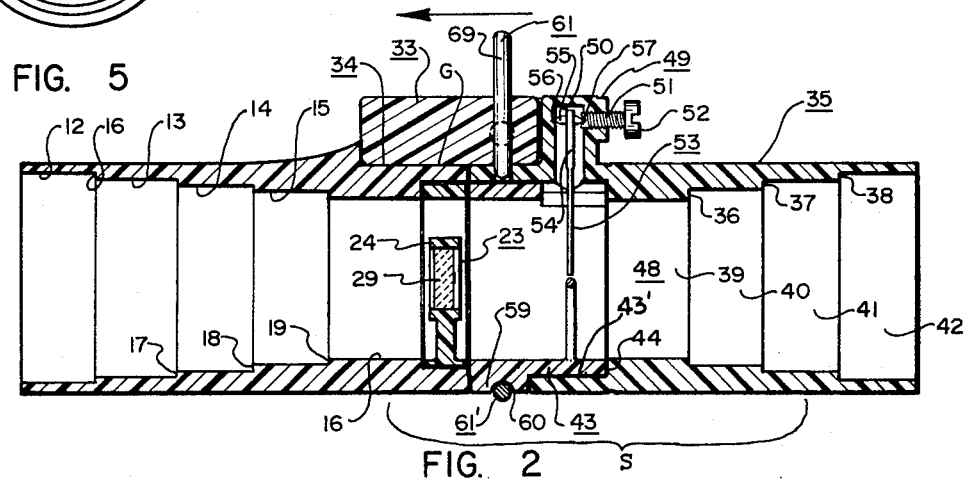
FIG. 2 is an elongate vertical section of the assembled sighting mechanism of FIG. 1 and is taken along the line 2—2 thereof.

Annular cover 35 serves as a light shield and is also seen in FIGS. 1 and 2.

Annular cover 35 has a series of mutually spaced, annular stepped shoulders 36–38 which provide a series of stepped annular recesses 39–42. A sighting reticle 43 is provided and is keyingly assembled to annular cover 35, by notch N with portion 59, in the manner seen in FIG. 2, i.e. within recess 43′ as defined by annular shoulder 44. This sighting reticle 43 has an annular case or ring 45 and, disposed therewithin, a T comprising a horizontal portion 46 and a vertical portion 47, the two essentially forming such "T". Such an assembly places the pivot axis A directly and normally vertically in line with sighting portion 47, with the sight properly adjusted and the bow held vertically. Portions 46 and 47 are conveniently referred to conjointly as a T-configured alignment sight 48.

Annular cover 35 includes an upstanding ear 49 provided with a hollow interior 50 and a drilled and tapped aperture 51 receiving threaded adjustment screw 52. Gravity-actuated pendulum 53 has a mounting portion 54, see FIG. 2, that is provided with needle journal 55. The points of the latter rest in point-receiving recess 56 of the ear interior and also central point recess 57 of adjustment screw 52. As to the operation of the screw, a tightening and loosening thereof regulates the dampening effect upon the pendulum 53, i.e. the responsiveness of the same in response to arcuate deflections of the sight. If desired, a small ball of silicone may be provided at each of the points of the pendulum mount to ensure proper opertion. Access opening 58 is provided in the sighting reticle unit 43 to accommodate the throughpassageway of the pendulum 53 and its swinging movement.

The bottom of sighting reticle 43 is provided with a protuberance 59 that is notched at 60 to receive clamping wire 61.

As to the mounting of resilient clamping wire 61, reference is now made to member 33. The latter comprises a block having an aperture 62 receiving adjustment screw 63. The latter may be mounted to a bow or a vertical slide block customarily supplied as a sight element attachment for a bow. Whatever the structure associated with screw 63, the same is designated at 65 in FIG. 1. Customarily, the threads 66 of adjustment screw 63 are provided for appropriate azimuth adjustment by suitable structure such as an adjustment nut, not shown. The attachment of a horizontal adjustment screw to a bow is strictly conventional and of itself constitutes no part of the present invention.

Annular cover 35 has an exterior groove 67 receiving locking wire 61. This groove 67 lies in the same vertical plane as notch 60 in FIGS. 1 and 2 so that the notch 60 as well as groove 67 receives the arcuate length 68 of the locking wire. In any event, a tight, frictional engagement is had between notch 60 and medial wire loop 61′ to enable exact alignment of the respective sights of axially aligned and contiguous housing 10 and annular cover 35, both, with block 33, wire 61, and reticle 43 forming elongate tubular enclosure structure S. Outer extremities 69 and 70 of the locking wire 61 proceed through apertures 71 and 72 of block member 33. Aperture 74 receives Allen screw 75 that is employed to lock ear 70 firmly in place within aperture 72. Allen screw 76 threads into aperture 77 and adjustably engages ear 69. Clamping or locking wire holds annular cover 35, with its recticle 43, in axial, rotatably adjustable disposition with respect to fixed housing 10.

Figure 4:
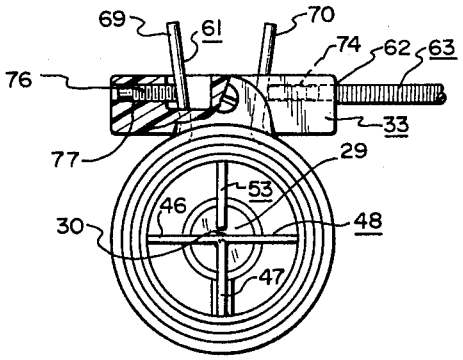
FIG. 4 is similar to FIG. 3 but illustrates a backingoff of the requisite adjustment screw so as to enable a correct alignment of the fixed portion of the rear sight with its pendulum.
Figure 3:
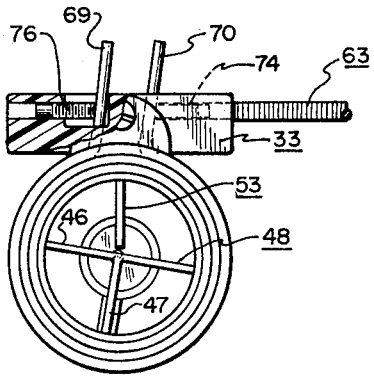
FIG. 3 is a view looking from right to left in FIG. 2, illustrating an over-adjustment of the reticle used in a clockwise direction, such that the same is in misalignment with the pendulum of the sight.

As to operation of the adjustment screw 76, it is seen that the same in engaging ear 69 in a thrusting direction, whereby rotating or rotationally displacing the keyed sighting reticle 43 and annular cover 35 in a clockwise direction, see FIG. 3, may result in an over-adjustment of the reticle marking 48 relative to pendulum 53. The adjustment screw thus can be blacked-off or unscrewed slightly, see FIG. 4, within threaded aperture 77 so that the sight at 48 becomes horizontally and vertically aligned as to its T-configurement, with both the pendulum and support and sighting post 27, see FIG. 4. This will be explained in greater detail hereinafter.

Assembly of the structure of FIG. 1 is seen in the manner shown in FIG. 3. An optional sighting reticle 43A, simply having an upstanding post 48A provided with a sighting ball-tip 46A, can be provided, this again in lieu of sighting reticle 43.

The various stepped recesses in housing 10 as at 12-15 and in annular cover 35 as at 39–42 are simply employed to eliminate glare, thus improving the effectiveness of the sight. In practice, block member 33 will be glued at G to the seat formed by surfaces 31 and 32. While for assembly purposes it is best that the sighting reticle 43 not be glued to annular cover or light shield 35, yet the same will be press-fit together and will move in tandem in accordance with the slight rotations made as to the adjustment of clamping wire 61.

Where post 27 is used, it will be generally horizontally thicker than the vertical index marking 47 of sight 48.

In operation, several methods of proper adjustment are possible.

One simple method is that, given that azimuth screw 63 is exactly horizontal and that its attachment to a bow in its horizontal condition will ensure a vertical position of the bow, then it is simply a matter of manually rotating sighting reticle 43, with screw 76 loosened, until the vertical indicator 47 comes exactly in line with the center of post 27. At that point a substantial alignment is achieved. A more exact adjustment is made possible by observing any dog-legged character as between the pendulum at 53 and the upstanding post marking 47, and thus correcting for such dog-legged character so that there is an exact vertical visual alignment as between the marking 47 and pendulum 53. This is achieved again by the very slight adjustment of screw 76 which will effect a very slight rotational movement of reticle 43 with annular cover 35, see FIG. 4.

Figure 5:
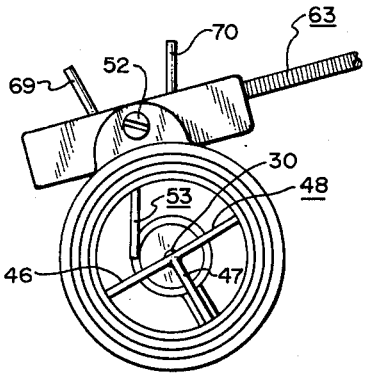
FIG. 5 illustrates, even after accurate calibration adjustment of the reticle has been made, the particular disposition of the fixed portion of the rear sight relative to its pendulum when the bow to which the sight is attaches is offvertical.

Assume that the elongate screw 63 is not horizontal, see FIG. 5. Then, for both elevating the screw 63 to an exact horizontal position and also adjusting the sight, all that is needed is to have an exact central location at marking 47 relative to post 27 and then bringing the end of the screw 63 up or down as needed until the bottom of the pendulum is in line with the dot 30 on lens 29; subsequently, it is simply a matter of rotationally adjusting the sighting reticle 43 or 43A until the vertical component of the marking thereof comes in exact alignment with the pendulum while the same is centered on the sighting dot 30. Final adjustments, to take any dog-legged or misalignment out of the combination of vertical index 47 and pendulum 53 can be made by simply rotating the adjustment screw 76 appropriately. In connection with the latter, the wire 61 grippingly or frictionally engages notch 60; thus, the urging of ear 69 inwardly or outwardly as by the adjustment of screw 76 will effect very, very slight but effective rotational displacement of the sighting reticle and the annular cover 35 with which it is keyed, so as to provide a perfect alignment such that post 47 is in alignment with post 27 and the pendulum is in alignment with the interception of post marking 47 and horizontal marking 46, with no dog-leg appearing as between the pendulum and post marking 47.

Thus, once the sighting mechanism is adjusted for accuracy in any manner as above indicated, then the user of a bow can be confident that he is on target when sighting his bow such that the pendulum bears upon the lens sighting dot, the vertical sighting post of the sighting reticle 43 is in rectilinear relationship with the pendulum, and the sighting reticle's horizontal bar 46 or ball 46A is aligned with the lens dot.

Accordingly, what is provided is a new and improved sight mechanism for shooting implements such as rifles, longarms and the like, but especially for archery bows that will be used for target shooting, competitive meets, and the like.

While particular embodiments of the invention have been shown and described, it will be obvious to those skilled in the art the various changes and modifications which may be made without departing from the essential features of the present invention and, therefore, the aim in the appended claims is to cover all such changes and modifications as fall within the true spirit and scope of the invention.

I claim:

1. Sighting structure including, in combination, elongate tubular enclosure structure, a front sight disposed forwardly in said enclosure structure and comprising a lens having a central sighting marking disposed thereon, said lens being annularly spaced from said enclosure structure by an essentially annular open viewing space, a rear sight rearwardly spaced with respect to said front sight and also positioning in said enclosure structure, said rear sight comprising a reticle alignable with said front sight.

2. The combination of claim 1 wherein said rear sight comprises a revolvably adjustable reticle.

3. The combination of claim 2 wherein said reticle includes a ring and a sighting T disposed in said ring.

4. The combination of claim 2 wherein said reticle includes a ring and an upstanding sighting post radially upstanding in said ring.

5. The combination of claim 2 wherein said enclosure structure comprises a pair of coaxial housings mutually rotatably secured together, said reticle being keyed to one of said housings.

6. The combination of claim 2 wherein said enclosure structure is provided with a pivotal pendulum movable in a transverse plane with respect to said enclosure structure, said pendulum being cooperatively disposed with respect to said reticle for alignment therewith.

7. The combination of claim 6 wherein said enclosure structure includes a hollow, outwardly protruding ear providing with inner space communicating with the interior of said enclosure structure, said ear being provided with adjustable means for pivotally supporting and adjustably dampening the motion of said pendulum.

8. The combination of claim 6 wherein said pendulum is provided with adjustment means for varying the dampening factor of said pendulum.

9. The combination of claim 2 wherein said enclosure structure is provided with a clamping wire having a central portion frictionally engaging said reticle for rotationally adjusting the latter, and first means for adjusting said clamping wire to so rotate said reticle.

10. The combination of claim 9 wherein said elongate tubular enclosure includes a fixed block having first and second enlarged apertures for receiving opposite extremities of said clamping wire, said first means comprising an adjustment screw threaded into said block, intersecting said first enlarged aperture, and positioned for progressive lateral thrusting contact with one of said clamping wire extremities, said enclosure structure including second means for retaining the remaining clamping wire extremity in said second enlarged aperture.

11. An archery bow sighting structure including, in combination, a pair of axially aligned, elongate, tubular housings, means for securing said housings together to permit rotational adjustment of one housing relative to the remaining housing, a horizontal elongate member extending outwardly from one of said housings and constructed for connection to archery bow structure, a lens mounted within and peripherally spaced inwardly of said one housing and having a central lens sighting marking, said one housing being provided with an interior vertical alignment and support post fixed to and supporting said lens, the remaining housing being provided with a rear sighting reticle having a vertical index alignable with said sighting marking of said lens and also said post, said remaining housing being provided with a depending pendulum mounted for alignment with said rear reticle vertical index and also with said lens post when said horizontal elongate member is so maintained on the horizontal, and means for adjusting the rotational disposition of said remaining housing to said one housing, whereby to effect sight alignment.

12. An archery bow sighting structure including, in combination, a pair of axially aligned, elongate, tubular housings, means for securing said housings together to permit rotational adjustment of one housing relative to the remaining housing, a horizontal elongate member extending outwardly from one of said housings and constructed for connection to archery bow structure, a lens mounted interior of and peripherally inwardly spaced from said one housing and having a central lens sighting marking, the remaining housing being provided with a rear sighting reticle having a vertical index alignable with said sighting marking of said lens, said remaining housing being provided with a depending pendulum mounted for alignment with said rear reticle vertical index when said horizontal elongate member is so maintained on the horizontal, and means for adjusting the rotational disposition of said remaining housing to said one housing, whereby to effect exact sight alignment.

13. Sighting structure including, in combination, elongate tubular enclosure structure, a front sight disposed forwardly in said enclosure structure and comprising a lens having a central sighting marking disposed thereon, said lens being annularly spaced from said enclosure structure by an essentially annular open viewing space, a rear sight rearwardly spaced with respect to said front sight and also positioned in said enclosures structure, said rear sight comprising a transversely swinging pendulum alignable with said central sighting marking.

* * * * *

UNITED STATES PATENT OFFICE

CERTIFICATE OF CORRECTION

Patent No. 3,997,974 Dated December 21, 1976

Inventor(s) MARLOW W. LARSON

It is certified that error appears in the above-identified patent and that said Letters Patent are hereby corrected as shown below:

Col. 2, line 55, change "backingoff" to read --backing-off--;
line 63, change "attaches" to read --attached--; same line, change "offvertical" to read --off-vertical--.

Col. 4, line 18, after "wire" insert --61--.
line 27, change "blacked-off" to read --backed-off--.

Col. 5, line 13, change "dog-legged" to read --dog-leg--.

Col. 5, Claim 1, line 55 (Claim line 8), change "positioning" to read --positioned--.

Col. 6, Claim 11, line 52 (Claim line 21), after "effect" insert --exact--.

Col. 8, Claim 13, line 5 (Claim line 9), change "enclosures" to read --enclosure--.

Signed and Sealed this

Twenty-second Day of March 1977

[SEAL]

*Attest:*

RUTH C. MASON
*Attesting Officer*

C. MARSHALL DANN
*Commissioner of Patents and Trademarks*